US005401141A

United States Patent [19]

Siebenwurst

[11] Patent Number: 5,401,141

[45] Date of Patent: Mar. 28, 1995

[54] MULTIPLE-FLOW LIQUID RING PUMP

[75] Inventor: Robert Siebenwurst, Nürnberg, Germany

[73] Assignee: Siemens Aktiengesellschaft, Munich, Germany

[21] Appl. No.: 150,030

[22] PCT Filed: Apr. 28, 1992

[86] PCT No.: PCT/EP92/00924

§ 371 Date: Nov. 15, 1993

§ 102(e) Date: Nov. 15, 1993

[87] PCT Pub. No.: WO92/20925

PCT Pub. Date: Nov. 26, 1992

[30] Foreign Application Priority Data

May 14, 1991 [EP] European Pat. Off. ..... 91107782

[51] Int. Cl.[6] ..... F04C 19/00

[52] U.S. Cl. ..... 417/68; 417/521

[58] Field of Search ..... 417/68, 69, 521

[56] References Cited

U.S. PATENT DOCUMENTS

| | | | |
|---|---|---|---|
| 3,228,587 | 1/1966 | Segebrecht | 417/68 |
| 3,275,222 | 9/1966 | Meyer . | |
| 4,132,504 | 1/1979 | Fitch | 417/68 |

FOREIGN PATENT DOCUMENTS

| | | | |
|---|---|---|---|
| 1057284 | 5/1959 | France | 417/68 |
| 1428243 | 7/1969 | France . | |
| 3445054 | 6/1986 | Germany | 417/68 |
| 37565 | 3/1980 | Japan | 417/68 |
| 0533276 | 2/1941 | United Kingdom . | |
| 587585 | 4/1947 | United Kingdom | 417/68 |

*Primary Examiner*—Richard A. Bertsch
*Assistant Examiner*—Roland G. McAndrews, Jr.
*Attorney, Agent, or Firm*—Kenyon & Kenyon

[57] ABSTRACT

The invention relates to a multiple-flow liquid ring pump having a rotor housing (1) which surrounds the rotor of the pump and on each of the two end sides of which there is arranged a side shield (2 or 3) which extends at least partially beyond the rotor housing (1) in radial direction, the two side shields (2 and 3) extending in each case beyond the rotor housing (1) at the same point with respect to each other of the circumference, and each side shield (2 or 3) having in its projecting region (corner 16) an inlet opening (7) and an outlet opening (8) on the side facing the corresponding other side shield, in which pump the opposite lying inlet and outlet openings (7 and 8) of the side shields (2 and 3) are connected to each other by connecting tubes (9) that extend parallel to the rotor housing (1), and a suction opening (13) for a feed line and a delivery opening (14) for a discharge line being provided. Such a liquid ring pump is characterized by the fact that it takes up little space and requires only little installation work at the site of installation.

12 Claims, 3 Drawing Sheets

MULTIPLE-FLOW LIQUID RING PUMP

BACKGROUND OF THE INVENTION

The present invention relates to a multiple-flow liquid ring pump.

In a liquid ring pump known from DE-B-10 57 284, sockets protrude radially with respect to a rotor housing and form inlet and outlet openings. These sockets are provided on side shields which are arranged on the ends of the rotor housing. Connecting pieces are connected to each other by corresponding connecting tubes. A suction socket and a delivery socket are present on each of these connecting tubes. These sockets are for the feeding and discharge lines. Due to this arrangement and development of the connecting tubes a large amount of space is required for the liquid ring pump. Furthermore, the connecting tubes can be mounted only at the site of installation of the liquid ring pump.

In another embodiment described in DE-B-10 57 284, connecting channels are developed within the rotor housing, extending between the two ends of the housing. In this way the space required for such a liquid ring pump is, to be sure, reduced. However, the resultant shape of the housing is still difficult to produce and machine.

SUMMARY OF THE INVENTION

The present invention provides a multiple-flow liquid ring pump that, while retaining a shape of housing which is favorable for manufacture, provides that the space required for the liquid ring pump is as small as possible.

According to an embodiment of the present invention, the liquid ring pump has a rotor, a rotor housing which surrounds the rotor, and two side shields, one arranged at each end side of the rotor housing. The side shields each have a projecting region that extends at least partially beyond the rotor housing at the same point with respect to each other's circumference. Each side shield has an inlet opening and an outlet opening on the side facing the corresponding other side shield in its projecting region. Connecting tubes connect opposite lying inlet and outlet openings and extend parallel to the rotor housing. The inlet and outlet openings provide a suction opening for a feed line and a delivery opening for a discharge line. In a liquid ring pump of this development, the connecting tubes are applied already at the time of manufacture of the pump and lie within the contour of the pump. In this way, the mounting of the pump at its place of use is substantially simplified.

By an angular development of the side shields as compared with a round rotor housing, there necessarily result protruding corners of the side shields in which the connection openings necessary for the connecting tubes can be arranged.

A purely insertion attachment of the connecting tubes is obtained in the manner that the inlet and outlet openings of the side shield are surrounded by a receiving rim and both ends of the connecting tubes rest sealed against the receiving rim of the opposite opening. The sealing is advisedly effected by means of an elastically hardening liquid sealing composition.

For the manufacture of the liquid ring pump it is favorable for the suction and delivery openings to be provided on one of the side shields. In this connection, it is, in turn, advantageous for the suction and the delivery openings to be provided on the end side of the side shield which lies on the side remote from the drive motor of the liquid ring pump.

Aside from the connecting tubes, tubes which serve for the feeding of operating liquid or for pressure equalization between the two pump halves of the liquid ring pump can also be connected in the same way as the connecting tubes to corresponding connection openings of the side shields. In this case, the connection openings are developed on the sides of the side shields facing each other so that the tubes to the rotor housing can be inserted extending parallel to each other between the side shields.

The invention will be described in further detail below with reference to an embodiment shown in the drawing.

DETAILED DESCRIPTION

Figure 1:
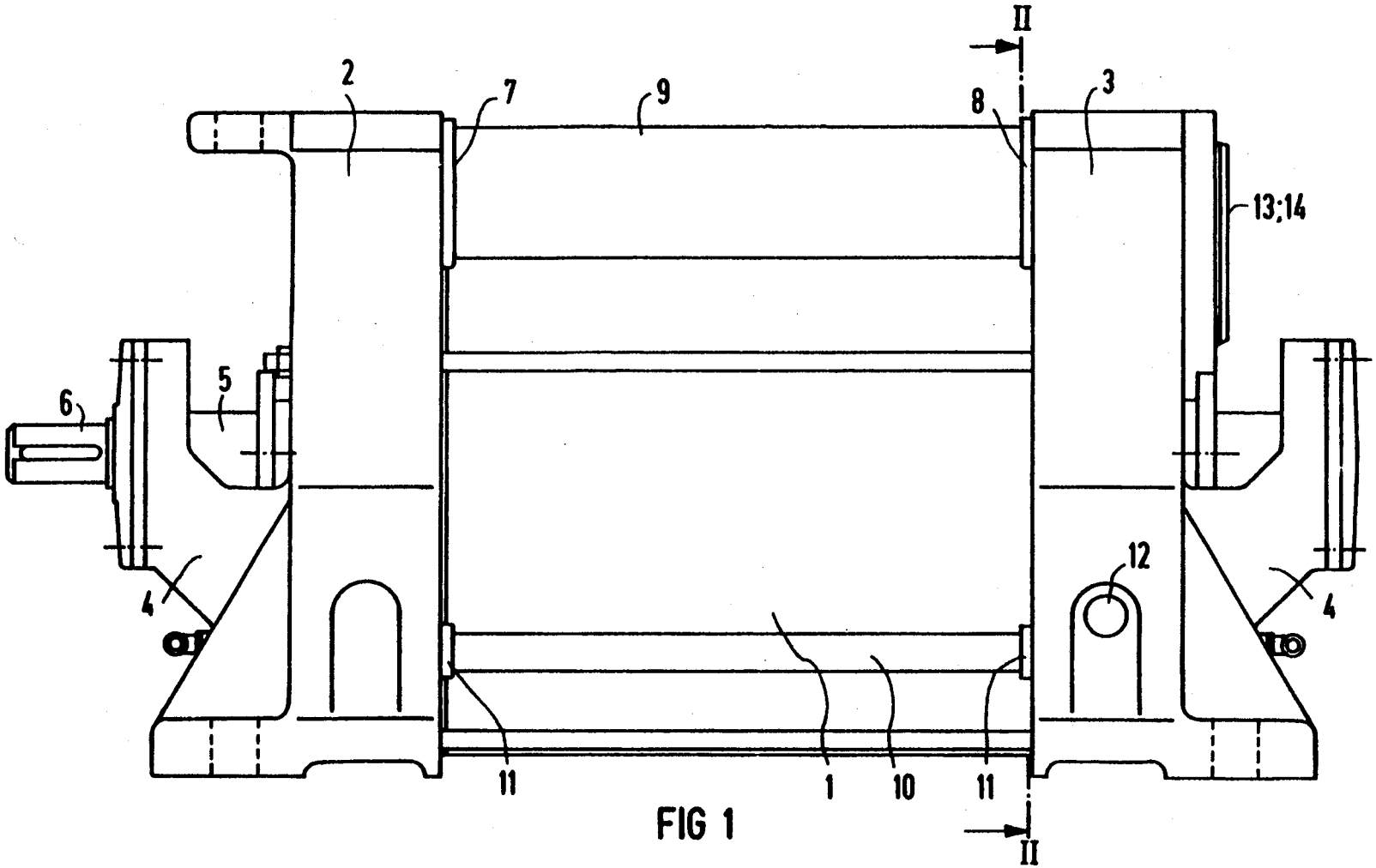
FIG. 1 illustrates a side view of a liquid ring pump according to an embodiment of the present invention.

A round rotor housing, i surrounds the rotor of the liquid ring pump. Side shields 2 and 3, are arranged on the two end sides of the housing. On each side shield 2 and 3 there is developed a support arm 4. The two support arms 4 contain the bearings for the mounting of the shaft 5 of the rotor. The liquid ring pump can be coupled to a drive motor by the shaft end 6 which protrudes from the corresponding bearing. The multiple-flow of the liquid ring pump is obtained with two rotors arranged within the rotor housing 1 and separated from each other by a housing partition, or with a rotor which is divided into two rotor halves by a central wall which is developed on the rotor and extends radially to the circumference of the rotor.

On their facing sides, the two side shields 2 and 3 have inlet and outlet openings 7 and 8. The two opposite openings 7 and 8 of the side shields 2 and 3 respectively are connected together by a straight connecting tube 9 which extends parallel to the rotor housing. Between the two side shields 2 and 3 there furthermore extends a tube which connects corresponding connecting openings 11 of the side shields 2 and 3 to each other. Operating liquid can be fed via this tube 10 from the one pump half to the other, or pressure equalization between the two pump halves can be brought about. Such a tube 10 can be provided on both longitudinal sides of the rotor housing 1 so that the feeding of operating liquid and the pressure equalization are both possible. For the feeding of the required operating liquid, a feed opening 12 need be present only on one side shield 3 in view of the arrangement of the tube 10.

On the side shield 3 which is arranged on the side opposite the drive side of the liquid ring pump, a suction opening 13 and a pressure opening 14 are provided on its end side.

Figure 2:
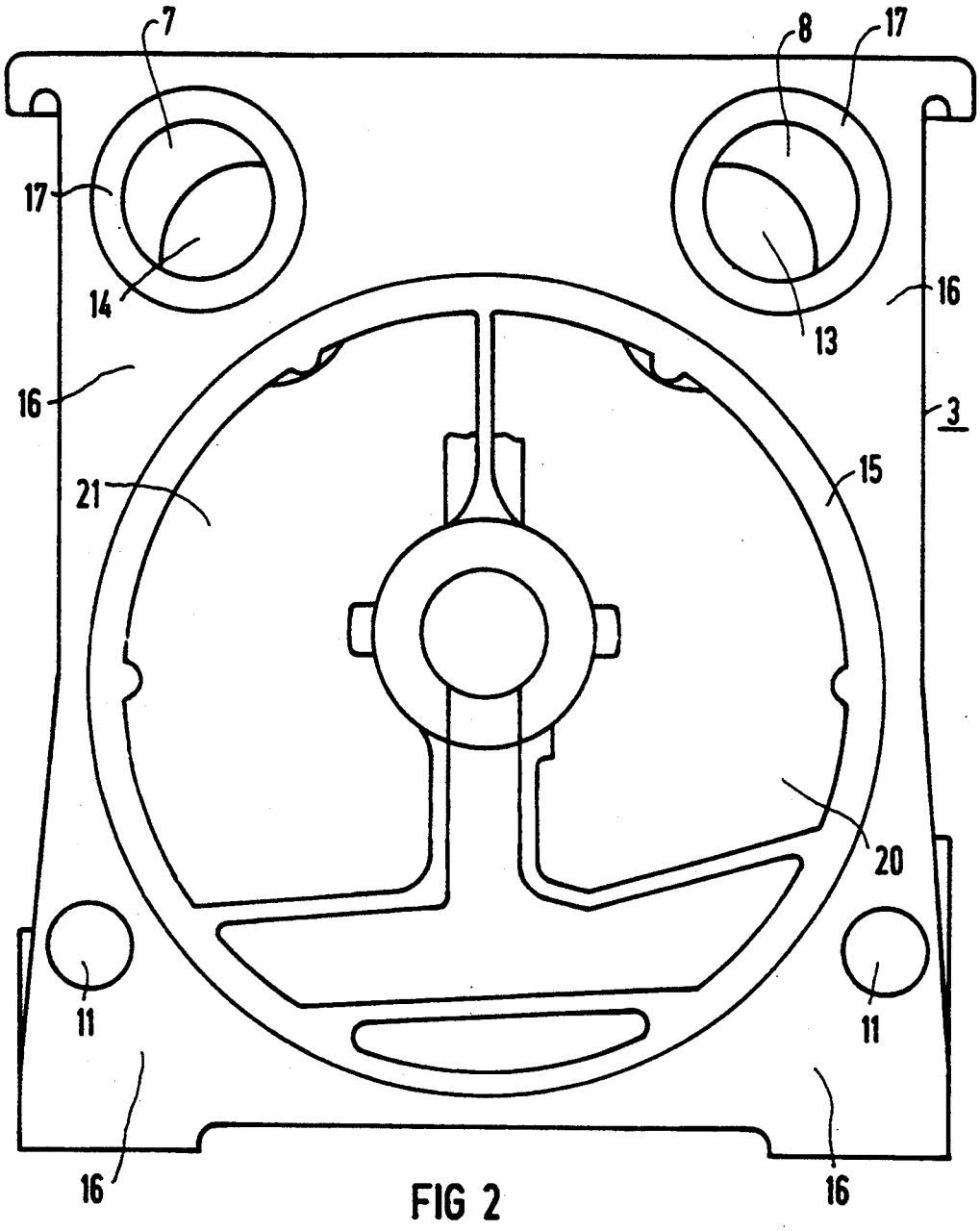
FIG. 2 illustrates a view of a side shield along the line I–II of FIG. 1.

As shown in FIG. 2, an annular connection rim 15 is developed on the side shield 3, by which rim the side shield 3 lies against the pump housing 1 with the interpositioning of a control disk. The side shields 2 and 3 are of rectangular development facing the round rotor housing 1. In this way, there result corners 16 of the side shields 2 and 3 which extend radially beyond the rotor housing 1. Within these corners 16 the inlet and outlet openings 7 and 8 as well as the connection openings 11 are developed on the facing sides of the side shields 2 and 3.

Figure 3:
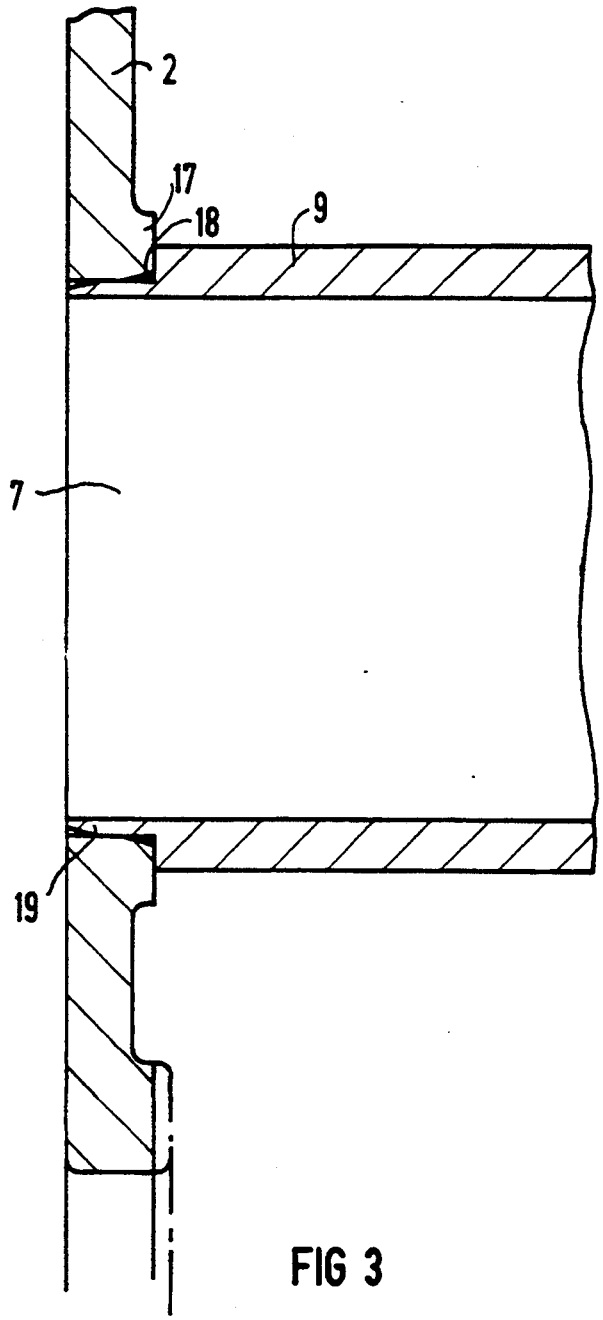
FIG. 3 illustrates an enlarged showing of the place of connection of a connecting tube to the corresponding opening of a side shield.

In particular, the inlet and outlet openings 7 and 8 are surrounded by their own receiving rim 17. Against this receiving rim 17 there rests the corresponding connecting tube 9, a packing 18 being interposed (FIG. 3). In order to facilitate the insertion of the connecting tube into the corresponding openings 7 and 8 and achieve a reliable seal in this opening 7 and 8, an insertion edge 19 is cut on the ends of the connecting tube 9. The packing 18 can consist of a liquid sealing composition which hardens elastically after introduction into the slot existing between the connecting tube 9 and the receiving rim 17.

Due to the fact that the connecting tubes 9 extend between the corners 16 of the side shields 2 and 3, they lie within the contour of the liquid ring pump which is determined by the side shields 2 and 3. Since these connecting tubes 9 are mounted already upon the manufacture of the liquid ring pump, the subsequent installation of the liquid ring pump is substantially facilitated. At the side of installation, it is merely necessary to connect the feed and discharge lines to the suction opening 13 and delivery opening 14 of the side shield 3.

The gas to be conveyed by the liquid ring pump is fed to the liquid ring pump via the feed line. The gas passes via the suction opening 13 into a suction chamber 20 which is developed on the side shield 3. The outlet opening 8 of this side shield 3 is in connection with this suction chamber 20 so that the gas passes via this outlet opening 8, the connecting tube 9, and the inlet opening 7 of the side shield 2 also into the suction chamber thereof. From the suction chambers 20 of the side shields 2 and 3, the gas flows through corresponding inlet slots in the control disk into the compression space of the liquid ring pump. After compression of the gas it is expelled in each case into a pressure chamber 21 provided on the side shields 2 and 3. In this connection, the gas which has been compressed in the one pump half passes through the pressure slots of the control disk directly into the delivery chamber 21 of the side shield 3. The gas compressed in the other pump half flows through the delivery slots in the corresponding disk first of all into the delivery chamber of the side shield 2 and from there, via the outlet opening 8 of the side shield 2, the connecting tube 9, and the inlet opening 7 of the side shield 3 into its delivery chamber 21. Via the delivery opening 14 which debouches into the delivery chamber 21 of the side shield 3, the gas can flow into the discharge line which is connected to the delivery opening 14 and be led away from the pump.

What is claimed is:

1. A multiple-flow liquid ring pump comprising:

a rotor;

a rotor housing which surrounds the rotor of the pump;

two side shields, one arranged at each end side of said rotor housing, wherein each side shield having a projecting region that extends at least partially beyond the rotor housing in a radial direction, in each case beyond the rotor housing at the same point with respect to each other of the circumference, each side shield having, in its projecting region, an inlet opening and an outlet opening on the side facing the corresponding other side shield;

connecting tubes connecting opposite lying inlet and outlet openings of said side shields and extending parallel to the rotor housing;

wherein said inlet and outlet openings provide a suction opening for a feed line and a delivery opening for a discharge line being provided.

2. The liquid ring pump according to claim 1, further comprising an additional connection opening on said side shields and at least one tube connected between corresponding additional connection openings which serves to feed operating liquid between two pump halves.

3. The liquid ring pump according to claim 1, further comprising an additional connection opening on said side shields and at least one tube connected between corresponding additional connection openings which serves to for pressure equalization between two pump halves.

4. The liquid ring pump of claim 1, in which said suction and delivery openings are provided on one of the side shields.

5. The liquid ring pump of claim 4, in which said one of said side shield upon which the suction and the delivery openings are provided lies on the side remote from the drive motor of the liquid ring pump.

6. The liquid ring pump of claim 1, wherein said rotor housing is round and said side shields are of angular development facing the round rotor housing on at least one side, wherein the inlet and outlet openings are provided on the protruding corners of the side shields.

7. The liquid ring pump according to claim 6, further comprising a receiving rim for each said inlet opening and outlet opening of said side shields, wherein two ends of each said connecting tube rest in sealed fashion against the receiving rim of the respective side shield openings.

8. A liquid ring pump of claim 7, wherein a sealing of said connecting tubes is effected by means of an elastically hardening liquid sealing composition.

9. The liquid ring pump according to claim 8, further comprising a receiving rim for each said inlet opening and outlet opening of said side shields, wherein two ends of each said connecting tube rest in sealed fashion against the receiving rim of the respective side shield openings.

10. A liquid ring pump of claim 9, wherein a sealing of said connecting tubes is effected by means of an elastically hardening liquid sealing composition.

11. The liquid ring pump of claim 9, in which said suction and delivery openings are provided on one of the side shields.

12. The liquid ring pump of claim 11, in which said one of said side shield upon which the suction and the delivery openings are provided lies on the side remote from the drive motor of the liquid ring pump.

* * * * *